US009151563B2

(12) United States Patent
Davis

(10) Patent No.: US 9,151,563 B2
(45) Date of Patent: Oct. 6, 2015

(54) TOOL FOR CLEANING FIREARMS AND METHOD OF USE

(76) Inventor: Jerry Lee Davis, Rudy, AR (US)

( * ) Notice: Subject to any disclaimer, the term of this patent is extended or adjusted under 35 U.S.C. 154(b) by 761 days.

(21) Appl. No.: 13/435,334

(22) Filed: Mar. 30, 2012

(65) Prior Publication Data

US 2013/0255722 A1 Oct. 3, 2013

(51) Int. Cl.
*B08B 3/00* (2006.01)
*F41A 29/02* (2006.01)

(52) U.S. Cl.
CPC ..... *F41A 29/02* (2013.01)

(58) Field of Classification Search
None
See application file for complete search history.

(56) References Cited

U.S. PATENT DOCUMENTS 3,602,935 A 9/1971 McDonnell
3,716,884 A 2/1973 Lavins
3,765,045 A 10/1973 Schneider
7,644,529 B2 1/2010 Hopper
2010/0186769 A1 7/2010 Jaquish
2011/0113669 A1 5/2011 Oselinsky

FOREIGN PATENT DOCUMENTS

WO WO03104740 12/2003

OTHER PUBLICATIONS

AR-15 Bolt Radius Scraper, Brownwells (Internet Advertisement Feb. 2012).

*Primary Examiner* — Eric Golightly
(74) *Attorney, Agent, or Firm* — Husch Blackwell LLP

(57) ABSTRACT

A tool for cleaning the bolt and bolt carrier of a firearm and a method using the tool are disclosed. The tool is preferably made from a single piece of rectangular metal having a longitudinal channel cut in one end to define first and second legs. The first leg is sized to fit within the bore a bolt. The channel is of a width to place an edge of the second leg adjacent the surface of the bolt. Rotating the tool in relation to the bolt scrapes an edge of the second leg against the surface of the bolt thereby removing carbon residue from the surface of the bolt.

7 Claims, 4 Drawing Sheets

TOOL FOR CLEANING FIREARMS AND METHOD OF USE

BACKGROUND OF THE INVENTION

The present invention relates generally to tools for cleaning firearms. More specifically, the invention relates to a tool for removing carbon residue from various parts of a firearm. Particularly, the invention relates to a tool for removing carbon residue from the bolt and bolt carrier of a firearm.

Firearms function due to the combustion of gunpowder. When gunpowder ignites it creates tremendous gas pressures that drive a projectile (or projectiles in the case of a shotgun) through and out the barrel of a gun at high rates of speed. The violent combustion of gunpowder and the expansion of gasses also causes carbonaceous residues to settle on various parts of the operating mechanisms of the firearm. The bolt and bolt carriers of automatic and semi-automatic weapons that utilize captured gas (such as the AR-15 rifle) are particularly susceptible to carbonaceous buildup. This buildup can hinder smooth movement of the bolt and cause jams that render the firearm inoperative.

In military and law enforcement situations, an inoperative firearm is not only useless, but a detriment to others. Soldiers and police officers with inoperative weapons can not aid their team members and must be protected. Thus, there is great emphasis placed on weapon maintenance.

There are several known devices for cleaning carbonaceous residue from bolts and bolt carriers. A listing of such devices and a description of a representative device are found in US Patent Application Publication 2010/0186769 to Jaquish et al., which is incorporated herein by reference. Unfortunately, these devices are not well suited for packing in the field.

Field maintenance of weapons can be burdensome because soldiers must carry tools with them. Modern soldiers now regularly carry fieldpacks weighing anywhere between 60-80 pounds. In addition, soldiers have a limited number of storage areas on their person and in their packs. Any innovation that can meet a soldier's maintenance needs while easing their packing burden, even by a few ounces, would be a significant improvement over known devices.

SUMMARY OF THE INVENTION

In one aspect, the invention is a lightweight, easily manufactured tool for cleaning parts of a firearm, particularly a bolt. The tool according to the invention is generally a thin, rectangular piece of metal that has a proximal end and a distal end. The proximal end has a longitudinally running channel that in part defines a first leg and a second leg. The channel is intermediate the first leg and second leg. The channel is positioned such that the first leg is dimensioned to be received within a bolt bore. The width of the channel is such that it can receive the wall of a bolt along its length. The second leg has scraping surface that doubles as an interior wall of the channel and is suitable for removing carbon buildup from the surface of a bolt when the tool is engaged with a bolt.

Another aspect of the invention is a method of cleaning a firearm that includes the step of providing a weapon having a bolt where the bolt has a bolt bore and a bolt wall. The method also includes the step of providing a tool for cleaning the bolt. The tool, as described in the preceding paragraph, has a proximal end and a distal end. The proximal end has a channel that in part defines a first leg and a second leg. The channel is situated intermediate the first leg and the second leg. The channel has a width sufficient to receive the bolt wall and the first leg is dimensioned to be received within the bolt bore. The second leg has a scraping surface.

The method continues by inserting the first leg into the bolt bore and initiating contact between the second leg scraping surface and the bolt followed by rotating the tool and bolt relative to one another.

BRIEF DESCRIPTION OF THE DRAWINGS

These and other more detailed and specific features of the present invention are more fully disclosed in the following specification, reference being had to the accompanying drawings, in which.

DETAILED DESCRIPTION OF THE INVENTION

In the following description, for purposes of explanation, numerous details are set forth, such as device configurations and movements, in order to provide an understanding of one or more embodiments of the present invention. Furthermore, the following detailed description is of the best presently contemplated mode of carrying out the invention based upon the existing prototype. The description is not intended in a limiting sense, and is made solely for the purpose of illustrating the general principles of the invention. The various features and advantages of the present invention may be more readily understood with reference to the following detailed description taken in conjunction with the accompanying drawings.

While the invention has been described with respect to various embodiments thereof, it will be understood by those skilled in the art that various changes in detail may be made therein without departing from the spirit, scope, and teaching of the invention. Accordingly, the invention herein disclosed is to be limited only as specified in the claims.

Figure 3:
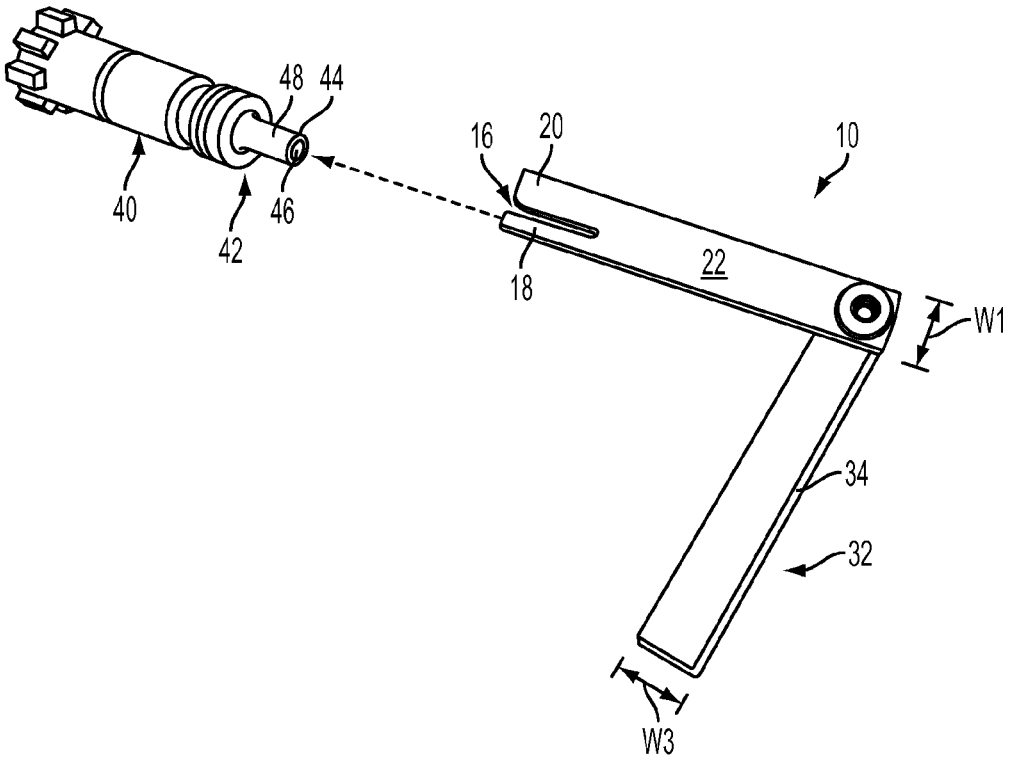
FIG. 3 shows a perspective view of the interaction between the tool and a bolt.
Figure 4:
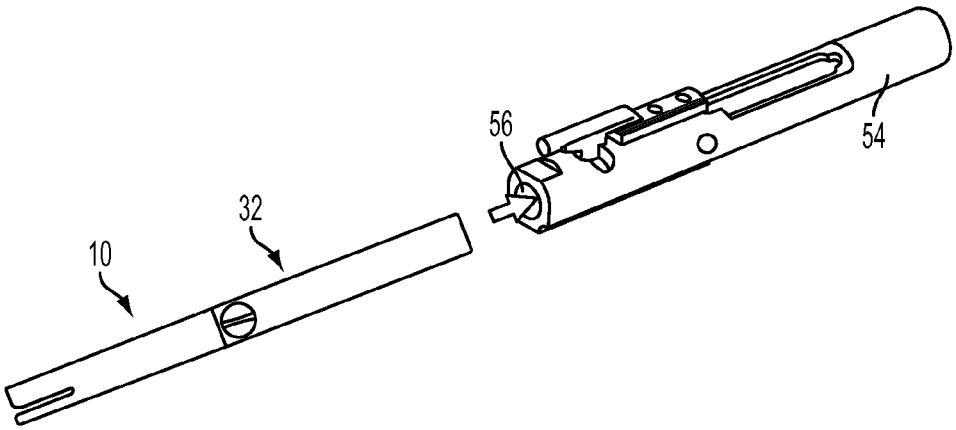
FIG. 4 shows a tool with the first leg of the proximal end positioned for insertion inside a bolt bore.

Referring now to the drawings in detail, where like numerals refer to like parts or elements, there is shown in FIGS. 3 and 4 a typical rifle bolt 40 and rifle bolt carrier 54 such as that found in a semi-automatic or automatic rifle (e.g., AR-15). The bolt 40 has a bolt tail 42 that is received within a cylindrical bolt carrier 54. The bolt tail 42 is generally cylindrical having a wall 44 that surrounds a bolt tail bore 46. In many bolts 40, the bolt tail 42 tends to flare towards the end of the bolt tail 42 that attaches to the bolt 40.

During operation, carbonaceous residue tends to build up on both the outer surface 48 and the inner surface of the cylindrical bolt tail 42 and on the interior surfaces of the cylindrical bolt carrier 54. The tool 10 according to the invention is designed to remove this residue from both the bolt 40 and the bolt carrier 54.

Figure 1:
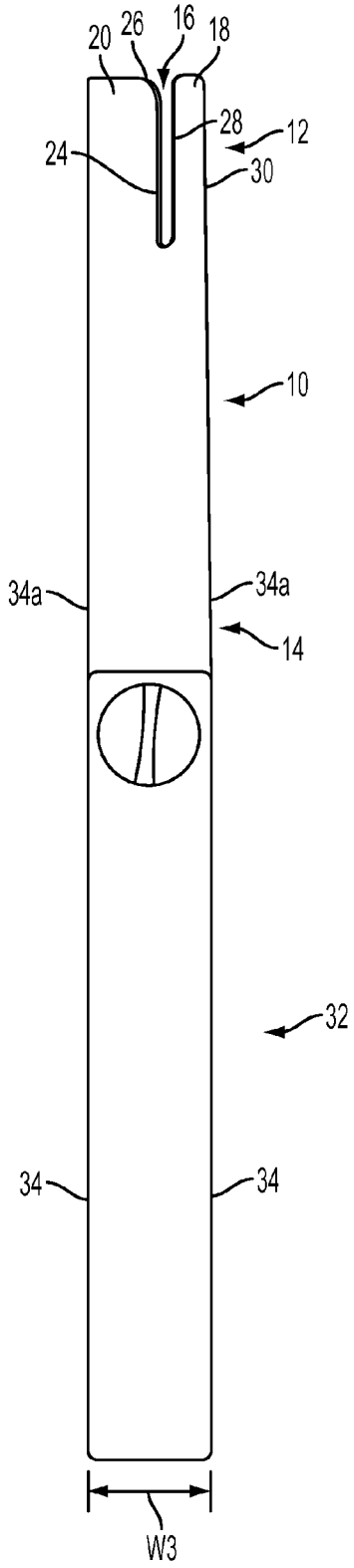
FIG. 1 shows a side view of a tool according to the invention.
Figure 2:
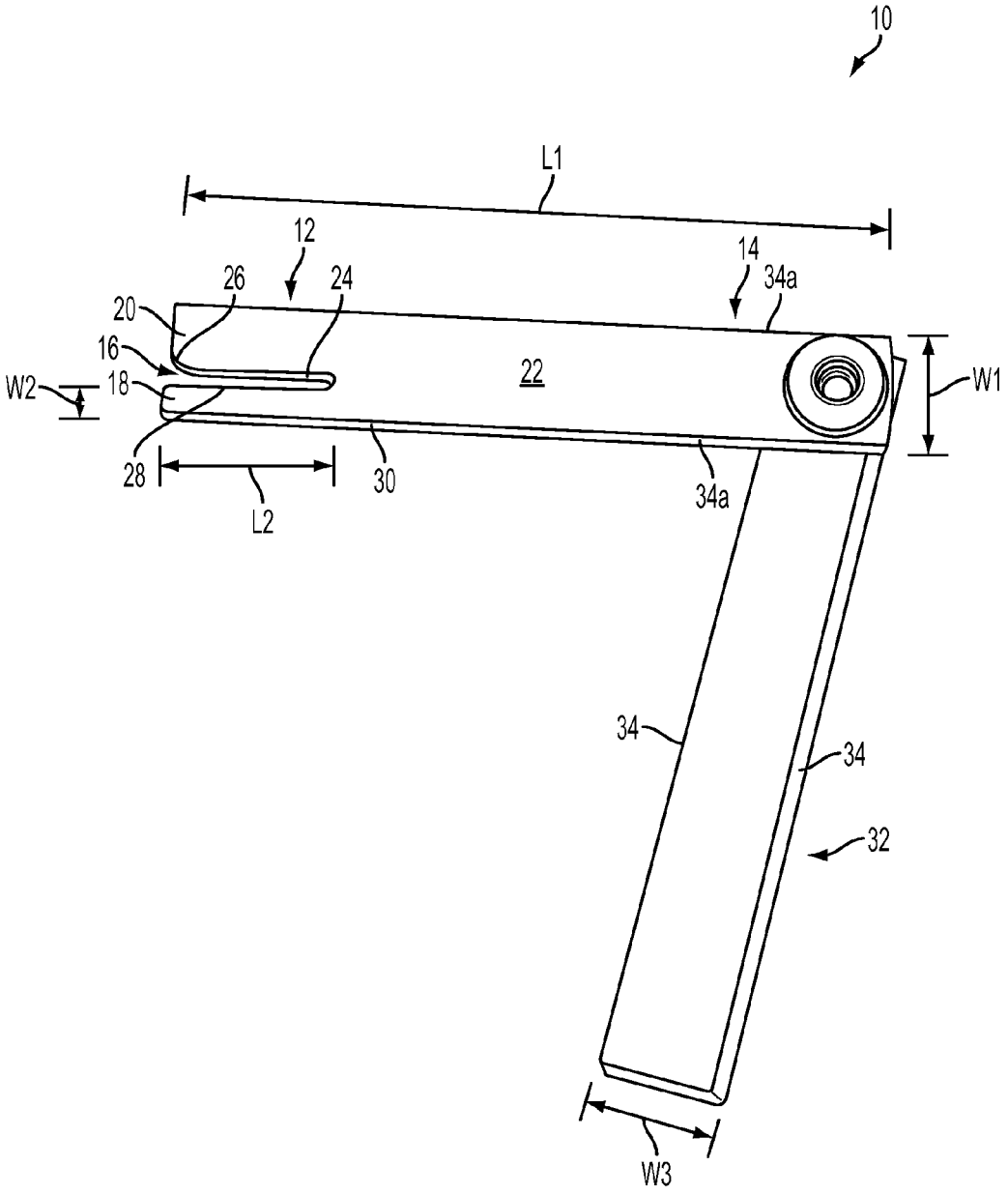
FIG. 2 shows a side perspective view of a tool according to the invention illustrating how it can be folded.

FIGS. 1 and 2 illustrate an embodiment of a rifle bolt cleaning tool 10 according to the invention. The tool 10 comprises a proximal end 12 and a distal end 14. The proximal end 12 is defined in part by a channel 16 that in turn aids in defining a first leg 18 and a second leg 20. The channel 16 is intermediate the first leg 18 and the second leg 20.

As shown in the figures, in preferred embodiments the tool 10 is formed from an elongated, single, flat piece of material that forms the tool body 22. The material that forms the tool body 22 should be of a strength and hardness sufficient to remove carbon residue from firearm parts. Preferably the tool body 22 is made from a metal with aluminum being a preferred metal due to its light weight and strength.

In preferred embodiments the tool body 22 is rectangular in shape and of a thickness that is sufficient to give the tool 10 the strength needed to resist bending or breaking during use. The length (L1) and width (W1) of the tool 10 can vary somewhat depending upon the particular needs of the user. For example, different rifles have different sized bolts and bolt carriers. Thus, different sized tools 10 may be needed depending on the type of weapon cleaned.

In addition, the flat design of the tool 10 is a preferred embodiment of the tool 10 for storage purposes. As mentioned previously, soldiers have a limited number of places to store equipment. One potential storage space for the tool 10 is in a small slot formed in the bottom of a handgrip of an assault rifle (i.e., an AR-15) or in the stock of a rifle. The ability to store a cleaning tool within the firearm itself is one of the benefits of the invention.

The channel 16 separates the first leg 18 and second leg 20 which oppose each other. The channel 16 extends from the edge of the proximate end 12 generally parallel to the longitudinal axis of the tool body 22 to a point distal the proximate end 12 thereby defining the length (L2) of the channel 16. The length L2 of the channel 16 should be sufficient to fully receive a bolt tail 42 as illustrated in FIG. 3. Accordingly, the width of the channel 16 should be at least as wide as the wall 44 of the bolt tail 42. Preferably the width of the channel 16 is such that bolt tail wall 44 fits snuggly, yet is readily received by and traverses the channel 16.

The channel 16 is positioned along the width W1 of the proximate end 12 such that the width W2 of the first leg 18 is not greater than the diameter of the bolt tail bore 46. Preferably, the width W2 of the first leg 18 is such that the first leg 18 may be received by the bolt tail bore 46 as shown in FIG. 3.

The inner walls of the channel 16 also define two edges. One such edge is identified as the scraping surface 24 of the second leg 20. As shown in FIG. 3, when the first leg 18 is received by the bolt tail bore 46 the scraping surface 24 of the second leg 18 slides just over the outer surface 48 of the bolt tail 42. In preferred embodiments the scraping surface 24 is further defined by an arcuate edge 26 that is positioned adjacent the proximal end terminus of the second leg 20. The arcuate edge 26 provides a curved scraping surface to better mate with the flared portion of a bolt tail 42 and facilitate the removal of carbon residue therefrom.

During use, the tool 10 is advanced toward a bolt 40 such that the channel 16 receives the bolt tail wall 44. The bolt tail wall 44 is advanced along the channel 16 for a distance sufficient to allow the scraping surface 24 of the second leg 20 to come into contact with the length of the bolt tail outer surface 48. More specifically, if the bolt tail 42 has a flared portion the bolt tail 42 is advanced along the channel 16 for a distance sufficient to bring the arcuate edge 26 of the second leg 20 into contact with the surface of the flared portion of the bolt tail 42.

Once the tool 10 has advanced onto the bolt 40, the bolt 40 and/or the tool 10 are axially rotated relative to one another while normal and/or shear forces are applied to either the bolt 40 or the tool 10 to bring the scraping surface 24 and arcuate edge 26 into contact with carbonaceous residue on the bolt tail surface 48. In other words, by holding the bolt 40 and the tool 10 in one's hands and rotating them against each other while applying pressure, one can scrape off carbon buildup on the outer surfaces of the bolt. It should be understood that such rotation can also cause the first leg inner surface 28 and/or the first leg outer surface 30 to scrape carbon build up from the inside surface of the bolt tail bore 46.

Particularly preferred embodiments of the tool 10 according to the invention include a bolt carrier cleaning portion that is capable of removing carbon buildup on the inside surface of a bolt carrier 54. A bolt carrier 54 is the component of a weapon that has a cylindrical bore 56 that receives the bolt 40 when the weapon is assembled.

The bolt carrier 54 cleaning portion of the tool 10 can take the form of the distal end 14 of the tool 10 or it can take the form of an extension piece 32 which is pivotally attached to the distal end of 14 of the tool 10. The determining factor regarding whether the distal end 14 of the tool 10 or an extension piece 32 serves as the bolt carrier 54 cleaning portion of the invention depends upon practitioner preference, length of the bolt carrier bore 56, and available storage space for the tool 10.

It is anticipated that in most instances the bolt carrier cleaning portion of the tool 10 will consist of a pivotally attached extension piece 32 to reduce the storage length of the overall device. This discussion will focus on an embodiment that incorporates an extension piece 32 but those skilled in the art will recognize that the distal end 14 of the tool 10 can be modified as necessary to provide the function of the extension piece 32.

In preferred embodiments the extension piece 32 generally mirrors the size, shape, and width (W1) of the tool 10. This is primarily because the extension piece 32 is inserted into a bolt carrier 54, which has a cylindrical bore 56 that receives the bolt 40 when the weapon is assembled.

Figure 5:
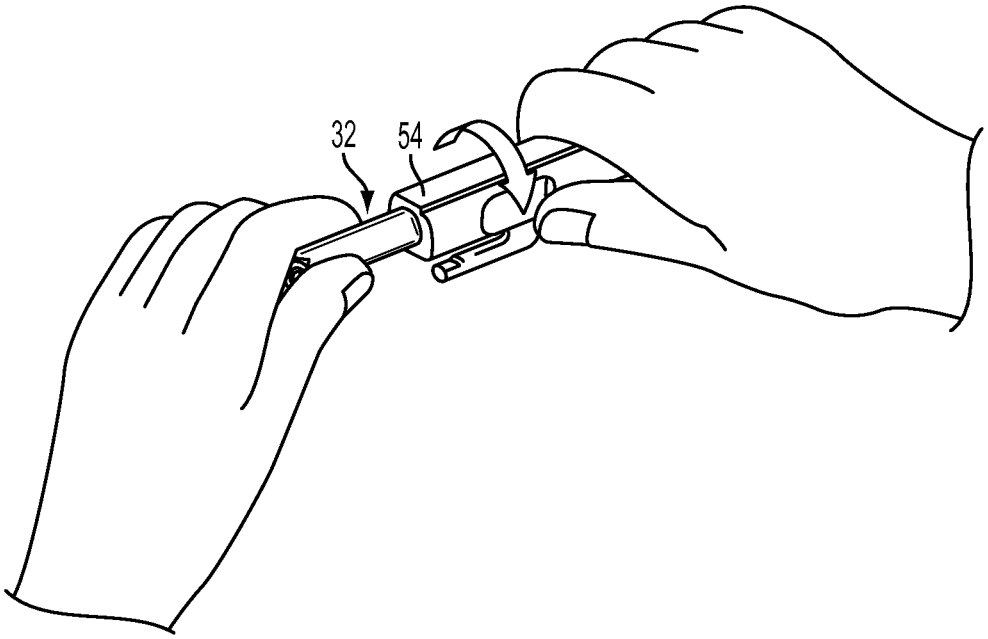
FIG. 5 illustrates axial movement of the tool as it is used to remove carbon buildup from firearm parts.

Thus, the extension piece 32 is generally of a width (W3) sufficient to allow the extension piece 32 to fit snuggly, yet freely traverse, the length of the bore 56 of the bolt carrier 54. It is envisioned that in most instances the extension piece 32 width (W3) will equal the width (W1) of the tool 10. Such an arrangement allows the scraping surfaces 34 of the extension piece 32 (and the corresponding scraping surfaces 34*a* of the distal end 14 of the tool 10) to come into contact with the inner walls of the bolt carrier cylindrical bore. As the extension piece 32 and the bolt carrier 54 are rotated relative to each other as shown in FIG. 5, the scraping surfaces 34 remove carbon buildup from the inner wall of the bolt carrier bore 56.

The invention also includes a method of cleaning a firearm. The method according to the invention includes the steps of providing a weapon having a bolt 40 with a bolt bore 46 and providing a tool 10 such as that described above. The bolt 40 and the tool 10 are advanced to receive each other as described above and as shown in FIG. 3. In particular, the first leg 18 of the tool 10 is inserted into the bolt bore 46 and advanced to allow the scraping surface 24 of the second leg 20 to come into contact with the length of the bolt tail outer surface 48. More specifically, if the bolt tail 42 has a flared portion, the bolt tail 42 is advanced along the channel 16 for a distance sufficient to bring the arcuate edge 26 of the second leg 20 into contact with the surface of the flared portion.

Contact is then initiated between the second leg scraping surface 24 and outer surface 48 of the bolt 40 followed by rotating the tool 10 and the bolt 40 relative to each other to allow the scraping surface 24 to remove carbon buildup. The contact and rotation illustrated in FIG. 5 with respect to the tool 10 and bolt carrier 54 is equally applicable to the interaction between the tool 10 and bolt 40. It should be understood that such rotation can also cause the first leg inner surface 28 and/or the first leg outer surface 30 to scrape carbon build up from the inside surface of the bolt tail bore 46.

In preferred embodiments of the method, the weapon also comprises a bolt carrier 54 having a bolt carrier cylindrical bore 56 for receiving the bolt 40. In these instances the tool 10 used in the practice of the method further comprises an extension piece 32 where the extension piece 32 can be integral with the distal end 14 of the tool 10 or it can be a separate piece that is pivotally attached to the distal end 14 of the tool 10 as shown in FIGS. 1 and 2. The extension piece 32 has at least one scraping surface 34 (or 34*a* if the extension piece is integral with the distal end 14 of the tool 10). The extension piece 32 is dimensioned to fit snuggly within, yet traverse, the bolt carrier cylindrical bore 56.

This embodiment of the method continues with the step of inserting the extension piece 32 into a bolt carrier cylindrical bore and rotating the extension piece 32 and the bolt carrier with respect to each other to remove any carbon buildup that may on the surface of the bolt carrier cylindrical bore. The steps of insertion and rotation are schematically shown in FIG. 5

In the drawings and specification, there have been disclosed typical embodiments on the invention and, although specific terms have been employed, they have been used in a generic and descriptive sense only and not for purposes of limitation, the scope of the invention being set forth in the following claims.

I claim:

1. A firearm bolt cleaning tool comprising:

a single and flat piece material having a proximal end and a distal end, said proximal end having a channel intermediate a first leg and a second leg, said first leg sized to be received within a bolt bore, and said second leg having a scraping surface.

2. A tool according to claim 1 wherein said channel extends from said proximal end of said tool to a point distal said proximate end to thereby define a length, said length sufficient to receive a bolt tail.

3. A tool according to claim 1 wherein said second leg scraping surface is defined by an arcuate edge, said arcuate edge adjacent the proximal end terminus of said second leg.

4. A tool according to claim 1 further comprising an extension piece, said extension piece pivotally attached to said distal end of said single piece of material of said tool and having an extension piece scraping surface.

5. The firearm bolt cleaning tool of claim 1 wherein said first leg and said second leg are fixed in relation to a remainder of said body.

6. A firearm bolt cleaning tool comprising:

a proximal end and a distal end, said proximal end having a channel intermediate a first leg and a second leg, said first leg sized to be received within a bolt bore, said second leg having a scraping surface; and an extension piece pivotally attached to said distal end of said tool and having an extension piece scraping surface.

7. A firearm bolt cleaning tool comprising:

a single, flat piece of material having at least two opposing flat surfaces, a proximal end and a distal end, said proximal end having a channel intermediate a first leg and a second leg, said first leg sized to be received within a bolt bore, said second leg having a scraping surface; and an extension piece pivotally attached to said distal end of said tool and having an extension piece scraping surface.

* * * * *